US005560652A

United States Patent [19]

Zoland

[11] Patent Number: 5,560,652

[45] Date of Patent: Oct. 1, 1996

[54] NOTE PAD WITH SINGLE HOLE OR PAIR OF SLITS AND WRITING INSTRUMENT COMBINATION

[76] Inventor: Martin Zoland, 26 Dow Street, South Melboure Victoria 3205, Australia

[21] Appl. No.: 404,356

[22] Filed: Mar. 15, 1995

Related U.S. Application Data

[63] Continuation-in-part of Ser. No. 263,053, Jun. 21, 1994, abandoned.

[51] Int. Cl.[6] ..... B42D 3/00

[52] U.S. Cl. ..... 281/30

[58] Field of Search ..... 281/29, 30, 31, 281/28, 15.1, 36, 51

[56] References Cited

U.S. PATENT DOCUMENTS

| | | | |
|---|---|---|---|
| 4,566,721 | 1/1986 | Friedman et al. | 281/30 |
| 5,029,899 | 7/1991 | Schieppati | 281/30 |

FOREIGN PATENT DOCUMENTS

| | | | |
|---|---|---|---|
| 529875 | 11/1940 | United Kingdom | 281/30 |
| 9420308 | 9/1994 | WIPO | 281/30 |

*Primary Examiner*—Willmon Fridie, Jr.

*Attorney, Agent, or Firm*—Blakely, Sokoloff, Taylor & Zafman

[57] ABSTRACT

A combination of a writing instrument and a note pad or calendar wherein the writing instrument can be easily attached to and removed from the note pad or calendar, A through-hole in the note pad or calendar is adapted to receive a pocket clip typically found on many conventional pens. Preferably, the clip has an upwardly curved end to facilitate insertion of the clip into the hole, especially where the note pad or calendar includes a number of sheets of paper requiring that the hole pass through each of the sheets. In a preferred embodiment, the through-hole is located near an edge of the note pad or calendar. Thus, a pen or other writing instrument can be secured to the note pad or calendar by inserting the clip through the hole.

44 Claims, 4 Drawing Sheets

NOTE PAD WITH SINGLE HOLE OR PAIR OF SLITS AND WRITING INSTRUMENT COMBINATION

This is a continuation-in-part of application Ser. No. 08/263,053, filed Jun. 21, 1994 now abandoned.

BACKGROUND OF THE INVENTION

1. Field of the Invention

The present invention relates to a note pads and calendars. More precisely, the present invention relates to the combination of a note pad or writing pad and a writing instrument attached thereto.

2. Description of the Prior Art and Related Information

Quite often, people who attend business meetings or school remember to bring a note pad but sometimes forget a writing instrument. Therefore, many techniques have been devised to connect one with the other. Where the note pad is part of a folder, U.S. Pat. No. 5,011,188 to Zoland et al. discloses a pen and folder combination. The folder has a hole disposed through both the front and back covers in an aligned orientation. A clip typically found on a pen can thus be inserted into the hole to simultaneously secure the pen to the folder and to clasp the covers of the folder together. Similar is U.S. Pat. No. 5,190,317 to Zoland which has a hole disposed through just one cover of a folder such that a clip typically found on a pen can thus be inserted into the hole to simultaneously secure the pen to the folder.

Similarly, it is frequently desirable to have a pen or other writing instrument readily accessible to a flat wall calendar in order to make annotations thereon such as birthdays, social events and the like.

SUMMARY OF THE INVENTION

The present invention provides a novel combination of a writing instrument and a note pad or calendar wherein the writing instrument can be easily attached to and removed from the note pad or calendar. In a preferred embodiment, the present invention provides a through-hole located near an edge of the note pad or calendar. The through-hole is adapted to receive a pocket clip typically found on many conventional pens, although, preferably, the clip has an upwardly curved end to facilitate insertion of the clip into the hole, especially where the note pad includes a number of sheets of paper requiring, in one embodiment, that the hole pass through each of the sheets. Thus, a pen or other writing instrument can be secured to the note pad or calendar by inserting the clip through the hole.

The present invention provides a superior method of holding the pen to the note pad than the conventional practice of simply clipping the pen to an edge of the note pad since the hole serves to limit movement of the writing instrument, reducing the likelihood of the writing instrument becoming dislodged. Similarly, with respect to a calendar-writing instrument combination, the present invention is superior to clipping the pen to an edge of the calendar or attaching the pen to the calendar by a string since the pen would be free to swing as people walk past the calendar, possibly causing markings on the wall on which the calendar is hanging. Further, the hole/clip combination can be shaped so that there is a snug fit between the clip and the hole thereby minimizing the chance of the clip unexpectedly slipping out of the hole.

Accordingly, the present invention provides a simple mechanism for attaching a writing instrument to a note pad or calendar, and a simple mechanism for removing the writing instrument from the note pad or calendar.

DETAILED DESCRIPTION OF THE INVENTION

In the following description, numerous details such as specific materials and configurations are set forth in order to provide a more complete understanding of the present invention. However, the present invention can be practiced without those specific details. In other instances, well-known elements are not described explicitly so as not to obscure the present invention.

Figure 1:
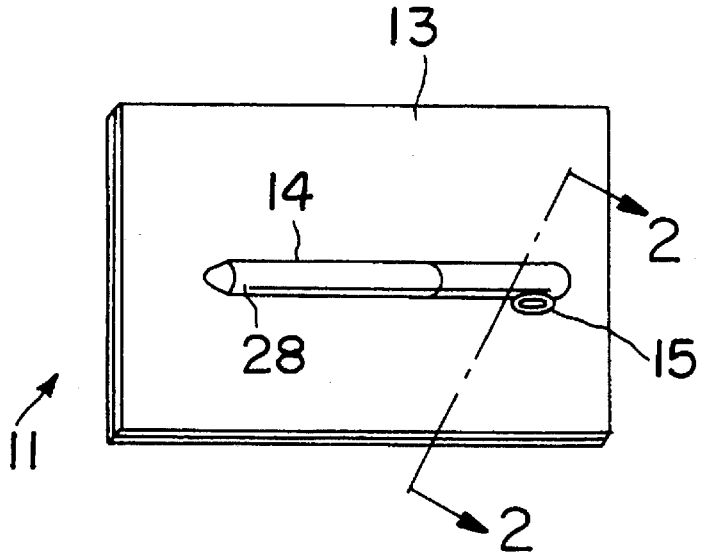
FIG. 1 is a perspective view of a preferred embodiment of the present invention, wherein a pen is clipped to a note pad by inserting the clip of the pen through the through-hole.

FIG. 1 shows a preferred embodiment of the present invention. A note pad 11 is shown having a front 13 and an identical back which is not shown. The back may be made of a stiff cardboard material or it may simply be the last page of the note pad. The note pad includes a number of paper pages and the optional cardboard back 14. Instead of a note pad, a wall calendar or other item having a relatively small number of pages having a front and a back, with or without an optional cardboard back could also be used to implement the invention.

Figure 3:
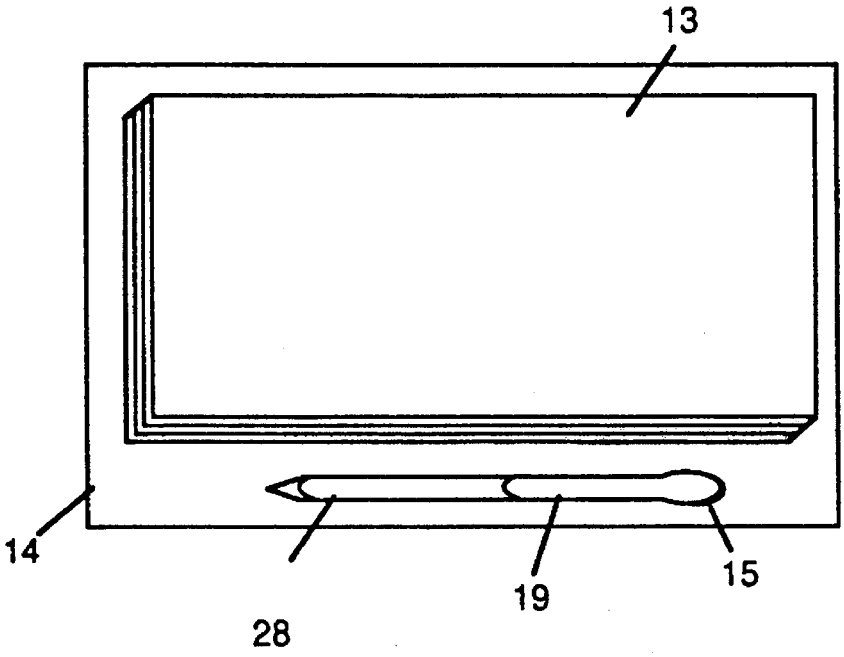
FIG. 3 is a perspective view of an alternate embodiment of the invention wherein the pen is clipped directly to a cardboard or other backing used to hold the note pad on the notepad side of the backing.

Unique in the present invention is a through-hole 15 disposed through the pages of the note pad or calendar and the optional cardboard back 14, or as shown in FIG. 3, through just the cardboard back, which in the FIG. 3 embodiment is not optional. The purpose of the through-hole 15 is to provide a point of attachment for a writing instrument 19. As shown in the perspective view of FIG. 1 and FIG. 3, the writing instrument 19, here a pen, is coupled to the note pad 11 via the through-hole 15. The coupling is accomplished by a pocket clip 23, found on almost all conventional pens and markers.

Figure 2:
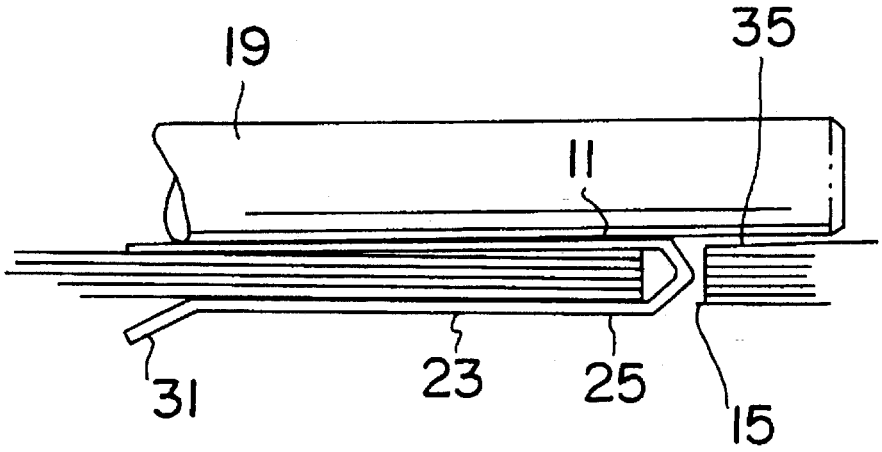
FIG. 2 is a profile view of the note pad and pen combination shown in FIG. 1 clearly depicting the clip and its relationship to the note pad and the through-hole after insertion.

FIG. 2 provides a side view of the note pad and pen combination illustrated in FIG. 1. As is detailed in the drawing, the clip 23 of the writing instrument 19 passes through the through-hole 15. A distal end 28 of the writing instrument 19 lies against the surface of the paper portion of note pad 13, or as shown in the FIG. 3 embodiment, against the surface of the cardboard backing 14. A proximal end 25 of the clip 23 rides at the lip of the through-hole 15. To facilitate insertion of the clip 23 into the through-hole 15, especially where the note pad includes a number of pages and/or a cardboard back making the note pad relatively thick, the clip may be configured to include a portion 31 at the end of the clip which curves upward, away from the body of the writing instrument 19.

To improve durability, the present invention provides that the through-hole 15 may be reinforced with another layer of material 35 if necessary or stiffened with a metal or plastic ring. The through-hole may also be reinforced with a reinforcement strip as is described below in the detailed description of FIG. 7. Other techniques for strengthening the through-hole 15 known in the art can be applied here as well.

Figure 4:
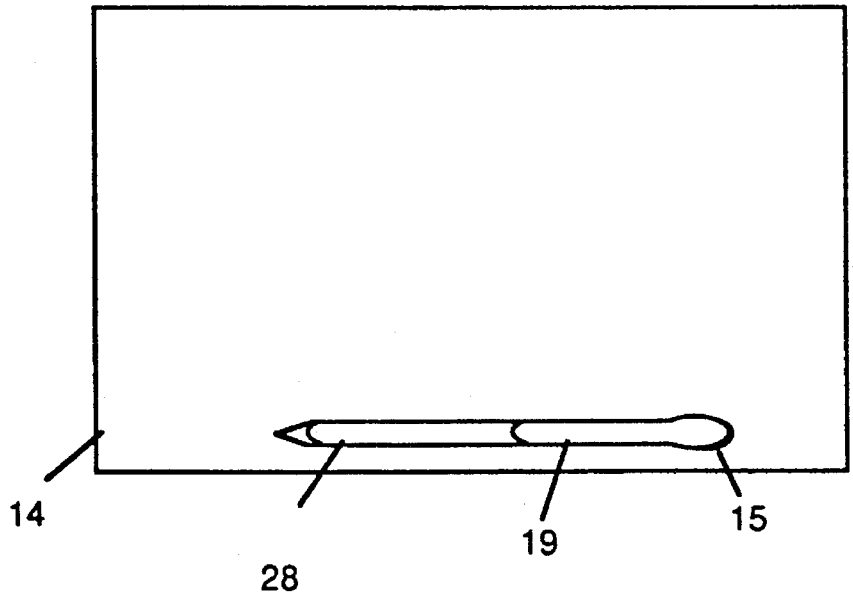
FIG. 4 is a perspective view of an alternate embodiment of the invention wherein the pen is clipped directly to a cardboard or other backing used to hold the note pad, on the side opposite the notepad side of the backing.

FIG. 4 is similar to FIG. 3 excepting that the writing instrument is disposed on the side of the backing opposite from the side used to hold the note pad.

Figure 5:
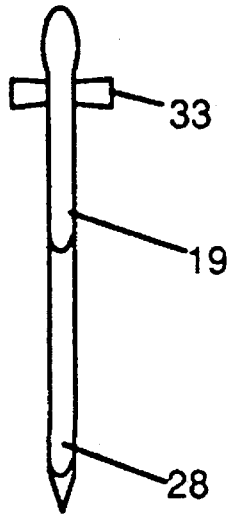
FIG. 5 is a side elevation view of a writing instrument having an alternate clipping mechanism for attachment to the note pad.
Figure 6:
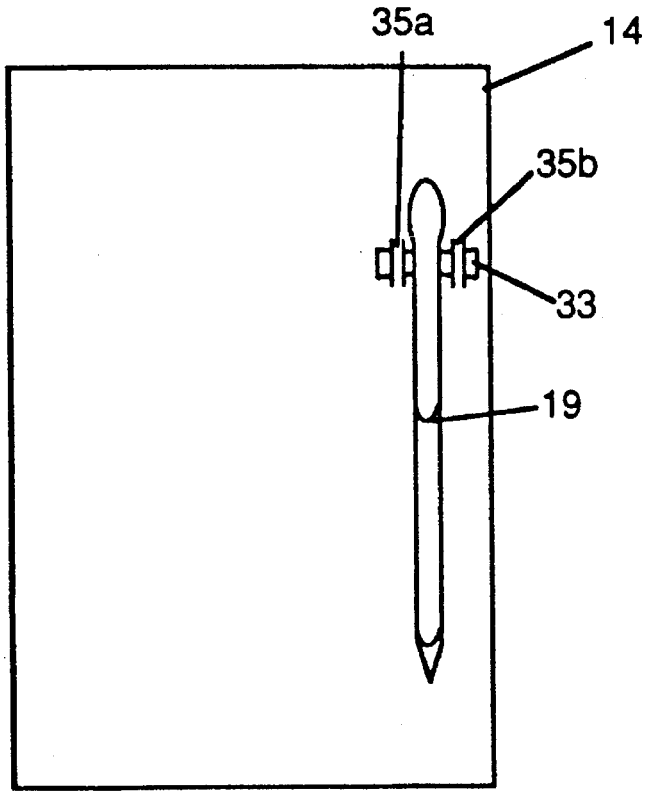
FIG. 6 is top plan of an alternate embodiment of a note pad and writing instrument combination.

FIG. 5 is an illustration of a modified writing instrument which instead of a clip which is generally parallel to the body of the pen as best seen in FIG. 2, has a clip which is generally perpendicular to the body of the writing instrument as shown in FIG. 5 with two wing portions extending from the body of the writing instrument. In the FIG. 5 embodiment, instead of a through-hole 15, the cardboard backing, if present, or paper, if there is no backing, includes two pairs of slits or cuts 35*a* and 35*b* into which the two wing portions of clip 33 are inserted as shown in FIG. 6.

Naturally, the through-hole can be located on various other locations of the note pad with the associated writing instrument connected in various orientations. These variations are within the scope and spirit of the present invention as defined in the appended claims.

Figure 7:
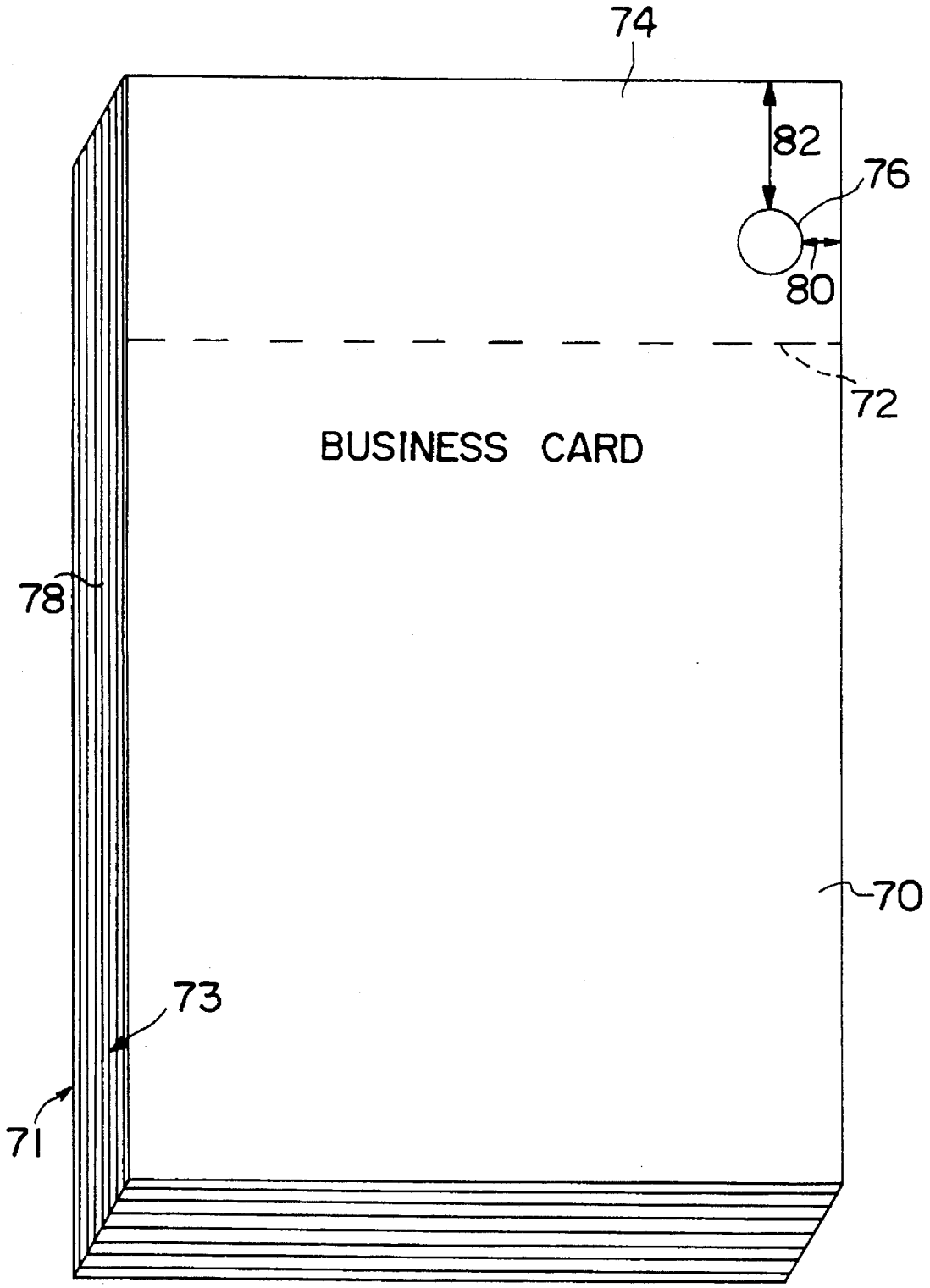
FIG. 7 is a top perspective view of an alternate embodiment of the invention wherein a reinforcement strip is on the front side of the memo pad.

FIG. 7 illustrates yet another embodiment of the present invention. The memo pad and writing instrument combination, in FIG. 7, includes a memo pad and a writing instrument (not shown). The memo pad has a front side 73 and a back side 71 and includes a plurality of sheets 78, typically ten sheets. The sheets are covered with a business card 70 and a reinforcement strip 74, which contains the through-hole 76. The business card 70 and the reinforcement strip 74 are connected by perforations 72, but the sheets of paper need not have any perforations.

In one embodiment the sheets are comprised of two part which may be detached by tearing along perforations that couple the two parts. The first and second parts are of the same size as the reinforcement strip and business card, respectively. Moreover, the first and second parts are disposed below the reinforcement strip and the business card, respectively, such that the perforations on the sheets coincide with perforations 72, which couple the reinforcement strip 74 to the business card 70. However, the perforations on the sheets need not coincide with perforations 72 in order to practice the present invention. Furthermore, the first and second parts of the sheets need not be disposed under the reinforcement strip and business card nor correspond to their size and shape.

The writing instrument, such as in FIGS. 1–4, has a body and a clip (which in turn has a distal and a proximal end) and can be coupled to the memo pad via the through-hole 76.

The business card can be removed by tearing along perforations 72 which connect the business card to the reinforcement strip 74. In the preferred embodiment the business card 70 is rectangular in shape and is 3.5 inches (88.9 mm) long and 2.3125 inches (58.7 mm) wide. The reinforcement strip 74 is also rectangular in shape, but it is 2.315 inches (58.7 mm) long and 1.25 inches (31.8 mm) wide. Again, it would be obvious to one of ordinary skill in the art to vary the shape and the size of both the business card and the reinforcement strip.

The through-hole 76 is preferably positioned such that the distance 80, from the edge of the through-hole 76 to the right side of the reinforcement strip 74, is 0.1875 inches (5 mm) long, while the distance 82 from the top edge of the through-hole 76 to the top of the reinforcement strip 74 is 0.375 inches (10 mm) long. The through-hole 76 can, of course, be alternatively positioned at many other locations such that the distances 80 and 82 can be considerably different from the distances cited above.

The memo pad in FIG. 7 can also be modified by including a cardboard back on the back side 71 of the memo pad. In another embodiment, a second reinforcement strip and a second business card or a card equal in size to the business card can be placed on the back side of the memo pad. The second reinforcement strip is preferably of the same shape and size as the reinforcement strip 74. Likewise the second business card or alternative card is of the same shape and size as the business card 70. However, as is obvious to one of ordinary skill in the art neither the reinforcement strips nor the business cards need be of the same size or shape. Thus, the reinforcement strips on the front and back sides of the memo pad can be of different size and shapes as can the business cards on the front and back sides of the memo pad.

Although the preferred embodiment of the invention has been described as having a business card 70, the business card 70 is not a necessary element of the invention. Therefore, one can implement the memo pad using a personal card instead of the business card 70 on both sides of the memo pad. Alternatively, one can use a card that is neither a business card nor a personal card. Finally, the present invention can be implemented such that the front or back side of the memo pad is not covered by a card at all.

The above description of the drawings provides details of the preferred embodiments of the present invention. It is of course apparent that the present invention is not limited to the detailed description set forth above. Various changes and modifications of this invention as described will be apparent to those skilled in the art without departing from the spirit and scope of this invention as defined in the following claims.

I claim:

1. A multi-page unit and writing instrument combination, said multi-page unit having a front side and a back side and a plurality of sheets of paper, said writing instrument including a body and a clip, said clip having proximal and distal ends, said combination comprising:

a through-hole disposed on said multi-page unit, said through-hole for receiving said clip of said writing instrument such that the distal end of the clip is insertable through the hole, such that the distal end of the clip lies against the back side of said multi-page unit and the body of the writing instrument lies against the front side of said multi-page unit.

2. A multi-page unit and writing instrument combination according to claim 1, wherein said through-hole is located substantially midway along an edge of said multi-page unit.

3. A multi-page unit and writing instrument combination according to claim 1, wherein said through-hole is reinforced with a means for stiffening.

4. A multi-page unit and writing instrument combination according to claim 1, wherein said distal end of said clip curves in a direction away from the body of the writing instrument.

5. A multi-page unit and writing instrument combination according to claim 1, wherein said multi-page unit comprises a plurality of paper pages.

6. A multi-page unit and writing instrument combination according to claim 5, wherein said multi-page unit further comprises a cardboard back.

7. A multi-page unit and writing instrument combination, said multi-page unit having a front side and a back side and a plurality of sheets of paper, said writing instrument including a body and a clip, said clip having proximal and distal ends, said combination comprising:

a through-hole disposed on said multi-page unit, said through-hole for receiving said clip of said writing instrument such that the distal end of the clip is insertable through the hole such that the distal end of the clip lies against the back side of said multi-page unit and the body of writing instrument lies against the front side of said multi-page unit; wherein said through-hole is disposed substantially midway along an edge of said multi-page unit, said through-hole is reinforced with a means for stiffening, and said distal end of said clip curves in a direction away from the body of the writing instrument.

8. A multi-page unit and writing instrument combination, said multi-page unit having a front side and a back side and a plurality of sheets of paper, said writing instrument including a body and a clip, said clip having proximal and distal ends, said combination comprising:

a through-hole disposed on said multi-page unit, said through-hole for receiving said clip of said writing instrument such that the distal end of the clip is insertable through the hole such that the distal end of the clip lies against the back side of said multi-page unit and the body of writing instrument lies against the front side of said multi-page unit; wherein said multi-page unit includes a plurality of paper pages and a cardboard back, said through-hole is disposed substantially midway along an edge of said multi-page unit, said through-hole is reinforced with a means for stiffening, and said distal end of said clip curves in a direction away from the body of the writing instrument.

9. The combination defined by claim 1 wherein said multi-page unit is a note pad.

10. The combination defined by claim 2 wherein said multi-page unit is a note pad.

11. The combination defined by claim 3 wherein said multi-page unit is a note pad.

12. The combination defined by claim 4 wherein said multi-page unit is a note pad.

13. The combination defined by claim 5 wherein said multi-page unit is a note pad.

14. The combination defined by claim 6 wherein said multi-page unit is a note pad.

15. The combination defined by claim 7 wherein said multi-page unit is a note pad.

16. The combination defined by claim 8 wherein said multi-page unit is a note pad.

17. The combination defined by claim 1 wherein said multi-page unit is a calendar.

18. The combination defined by claim 2 wherein said multi-page unit is a calendar.

19. The combination defined by claim 3 wherein said multi-page unit is a calendar.

20. The combination defined by claim 4 wherein said multi-page unit is a calendar.

21. The combination defined by claim 5 wherein said multi-page unit is a calendar.

22. The combination defined by claim 6 wherein said multi-page unit is a calendar.

23. The combination defined by claim 7 wherein said multi-page unit is a calendar.

24. The combination defined by claim 8 wherein said multi-page unit is a calendar.

25. The combination defined by claim 1 wherein said multi-page unit further comprises a cardboard back and through-hole passes only through said cardboard back.

26. The combination defined by claim 6 wherein said through-hole passes only through said cardboard back.

27. The combination defined by claim 8 wherein said through-hole passes only through said cardboard back.

28. A multi-page unit and writing instrument combination, said multi-page unit having a front side and a back side and a plurality of sheets of paper, said writing instrument including a body and a clip, said clip having proximal and distal ends, said combination comprising:

a through-hole disposed on said multi-page unit, said through-hole for receiving said clip of said writing instrument such that the distal end of the clip is insertable through the hole, such that the distal end of the clip lies against the front side of said multi-page unit and the body of the writing instrument lies against the back side of said multi-page unit.

29. A multi-page unit and writing instrument combination, said multi-page unit having a front side and a back side and a plurality of sheets of paper, said writing instrument including a body and a clip, said clip having proximal and distal ends, said combination comprising:

a through-hole disposed on said multi-page unit, said through-hole for receiving said clip of said writing instrument such that the distal end of the clip is insertable through the hole such that the distal end of the clip lies against the front side of said multi-page unit and the body of writing instrument lies against the back side of said multi-page unit; wherein said through-hole is disposed substantially midway along an edge of said multi-page unit, said through-hole is reinforced with a means for stiffening, and said distal end of said clip curves in a direction away from the body of the writing instrument.

30. A multi-page unit and writing instrument combination, said multi-page unit having a front side and a back side and a plurality of sheets of paper, said writing instrument including a body and a clip, said clip having proximal and distal ends, said combination comprising:

a through-hole disposed on said multi-page unit, said through-hole for receiving said clip of said writing instrument such that the distal end of the clip is insertable through the hole such that the distal end of the clip lies against the front side of said multi-page unit and the body of writing instrument lies against the back side of said multi-page unit; wherein said multi-page unit includes a plurality of paper pages and a cardboard back, said through-hole is disposed substantially midway along an edge of said multi-page unit, said through-hole is reinforced with a means for stiffening, and said distal end of said clip curves in a direction away from the body of the writing instrument.

31. The combination defined by claim 28 wherein said multi-page unit further comprises a cardboard back and said through-hole passes only through said cardboard back.

32. The combination defined by claim 29 wherein said multi-page unit further comprises a cardboard back and said through-hole passes only through said cardboard back.

33. The combination defined by claim 30 wherein said through-hole passes only through said cardboard back.

34. A multi-page unit and writing instrument combination, said multi-page unit having a front side and a back side and a plurality of sheets of paper, said writing instrument including a body and a clip, said combination comprising:

two pairs of slits disposed on said multi-page unit, said two pairs of slits for receiving said clip of said writing instrument such that a first end of the clip is insertable through one of said two pairs of slits and a second end of the clip is insertable through the other of said two pairs of slits 35. The multi-page unit defined by claim 34 wherein said multi-page unit includes a cardboard back and said two pairs of slits pass through said cardboard back.

36. A memo pad and writing unit combination comprising:

a memo pad, having a front side and a back side and comprising a plurality of sheets of paper;

a first reinforcement strip disposed on the front side of said memo pad;

a through-hole disposed on said first reinforcement strip, wherein said through-hole is reinforced with said first reinforcement strip; and a writing instrument including a body and a clip, said clip having a proximal end and a distal end, wherein said distal end of said clip is insertable through said through-hole such that the distal end of the clip lies against the back side of said memo pad and the body of the writing instrument lies against the front side of said memo pad.

37. The memo pad and writing instrument combination of claim 36, further comprising a first business card coupled to said first reinforcement strip via first perforations, wherein said first business card is detachable from said first reinforcement strip along said first perforations.

38. The memo pad and writing instrument combination of claim 36, further comprising a cardboard disposed on the back side of said memo pad, wherein said through-hole disposed on said first reinforcement strip is also disposed on said cardboard and further wherein said through-hole is further reinforced with said cardboard.

39. The memo pad and writing instrument combination of claim 37, further comprising a cardboard disposed on the back side of said memo pad, wherein said through-hole disposed on said first reinforcement strip is also disposed on said cardboard and further wherein said through-hole is further reinforced with said cardboard.

40. The memo pad and writing instrument combination of claim 37, further comprising a second reinforcement strip and a second business card, wherein said second reinforcement strip and said second business card are disposed on the back side of said memo pad and further wherein said through-hole disposed on said first reinforcement strip is also disposed on said second reinforcement strip such that the through-hole is further reinforced with said second reinforcement strip.

41. The memo pad and writing instrument combination of claim 36, further comprising a first card coupled to said first reinforcement strip via first perforations, wherein said card can be uncoupled from said first reinforcement strip by tearing along said first perforations.

42. The memo pad writing instrument combination of claim 41, further comprising a cardboard disposed on the back side of said memo pad, wherein said through-hole disposed on said first reinforcement strip is also disposed on said cardboard and further wherein said through-hole is further reinforced with said cardboard.

43. The memo pad and writing instrument combination of claim 41, further comprising a second reinforcement strip and a second card, wherein said second reinforcement strip and said card are disposed on the back side of said memo pad and further wherein said through-hole disposed on said first reinforcement strip is also disposed on said second reinforcement strip such that said through-hole is further reinforced with said second reinforcement strip.

44. The memo pad and writing instrument combination of claim 36, wherein each of said plurality of sheets of paper comprises a first part and a second part such that said first part is disposed underneath said first reinforcement strip and said first part is coupled to said second part via sheet perforations, further wherein said first part is detachable from said second part along said sheet perforations.

* * * * *